United States Patent [19]

Yates, Jr.

[11] Patent Number: 4,886,126

[45] Date of Patent: Dec. 12, 1989

[54] METHOD AND APPARATUS FOR FIRING A PERFORATING GUN

[75] Inventor: Donald N. Yates, Jr., Cape Carancahua, Tex.

[73] Assignee: Baker Hughes Incorporated, Houston, Tex.

[21] Appl. No.: 282,595

[22] Filed: Dec. 12, 1988

[51] Int. Cl.[4] ..... E21B 43/117; E21B 43/1185

[52] U.S. Cl. ..... 175/4.54; 166/55; 166/65.1; 166/297; 166/64; 175/4.52

[58] Field of Search ..... 175/4.54, 4.52; 166/55, 166/63, 297, 53, 55.1, 65.1, 113, 64, 317, 319

[56] References Cited

U.S. PATENT DOCUMENTS

| | | | |
|---|---|---|---|
| 2,760,408 | 8/1956 | Taylor | 175/4.54 |
| 3,648,785 | 3/1972 | Walker | 175/4.54 |
| 4,544,034 | 10/1985 | George | 175/4.54 X |
| 4,560,000 | 12/1985 | Upchurch | 175/4.54 X |
| 4,564,076 | 1/1986 | Vann et al. | 166/297 X |
| 4,650,010 | 3/1987 | George et al. | 175/4.54 X |
| 4,678,044 | 7/1987 | Luke et al. | 175/4.54 X |
| 4,770,246 | 9/1988 | Ward | 175/4.54 X |

*Primary Examiner*—Stephen J. Novosad

*Attorney, Agent, or Firm*—Hubbard, Thurman, Turner & Tucker

[57] ABSTRACT

An electrically operated firing piston is provided for effecting the firing of a perforating gun in a subterranean well. The electrical firing system is disposed within a hollow housing which is detachably secured to the gun and is subject to the fluid pressures surrounding the perforating gun. The electrical firing system is armed through the application of a fluid pressure to the exterior of the housing which is in excess of the well hydrostatic pressure, thereby preventing premature firing of the perforating gun before insertion at its desired position in the well. The generation of an electrical firing pulse is controlled by a microprocessor which is preset to be responsive only to a selected value of fluid pressure surrounding the control housing. Thus, the pressure surrounding the perforating gun may be reduced to a selected under-balanced condition before the firing of the gun can be effected.

7 Claims, 3 Drawing Sheets

METHOD AND APPARATUS FOR FIRING A PERFORATING GUN

BACKGROUND OF THE INVENTION

1. FIELD OF THE INVENTION: The invention relates to a method and apparatus for controlling the firing of a well perforating gun so that the gun is fired under optimum pressure conditions surrounding the gun.

2. SUMMARY OF THE PRIOR ART: The perforating of subterranean wells in a so-called underbalanced condition is a technique that has been widely heretofore employed. Briefly, such technique involves the utilization of a tubing conveyed perforating gun which, together with a packer located on the tubing string above the perforating gun is lowered to the desired position in the well casing. The packer is then set and the fluid pressure existing around the perforating gun is then reduced to a desired level, substantially below hydrostatic fluid pressure. Such reduced fluid pressure may be achieved by recirculating a light density fluid into the tubing string, by swabbing the tubing, or by running the tubing string into the well in a dry condition and incorporating a normally closed valve in the lower portions of the tubing string, then opening such valve after the packer has been set.

There is, of course, the accompanying problem of insuring that the perforating gun is not prematurely discharged during its insertion into the well. One prior art approach for solving this problem is to utilize a firing mechanism which incorporates a selected time delay. Once this firing mechanism has been placed in operation, the operator knows the amount of time available to him to achieve the desired fluid pressure conditions surrounding the perforating gun in order to fire at the optimum underbalanced condition.

It often happens that unforseen circumstances prevent the operator from achieving the desired underbalanced pressure condition prior to the end of the time delay and the firing of the perforating gun occurs under less than optimum conditions.

There is a need, therefore, for a firing control system for a well perforating gun which will insure against premature firing of the perforating gun during insertion of the gun into the well, or removal of the gun in the event that unforseen conditions prevent the firing of the gun. Additionally, the desired firing control system should not effect the firing of the gun until the optimum underbalanced fluid pressure conditions surrounding the gun have been attained, regardless of the amount of time required to effect such attainment.

BRIEF DESCRIPTION OF THE INVENTION

A perforating gun embodying this invention is lowered into the well on a tubing string which also carries a packer at a location above the perforating gun. When the perforating gun is located at the desired position in the well, the packer is set. The firing control system embodying this invention is contained within a sealed hollow housing which is detachably securable to the top end of the perforating gun. Thus, such housing may be lowered into the well with the gun or may be inserted in the well by wireline and sealably secured to the top end of the perforating gun.

One wall of the control housing, for example, the top wall, incorporates a fluid pressure responsive rupture disc. Such disc is selected to rupture in a response to an external pressure significantly in excess of the anticipated hydrostatic fluid pressure existing within the well at the level at which the gun is positioned. The rupturing of the fluid pressure responsive rupture disc permits well pressures to be applied to a cylinder within which is mounted a piston which moves downwardly to effect the closing of a micro switch.

The control housing contains a power supply which is connected through the aforementioned micro switch to an electrical detonator and a microprocessor which in turn controls the generation of an electrical firing impulse which is applied to the electrical detonator. The detonator, when fired by the microprocessor, in turn effects the detonation of a booster charge disposed in the perforating gun. Such booster charge detonates the primer cord which conventionally leads to the various shaped charges mounted in the gun.

Thus, the firing control system is not armed until the rupture disc has been ruptured and thus effects the connection of the electrical power supply to the microprocessor.

The microprocessor is designed so as to produce a firing impulse only when a preselected fluid pressure exists around the exterior of the control housing. Such exterior fluid pressure is detected by a pressure transducer mounted within the control housing and placed in contact with the external fluid pressure through the rupturing of the rupture disc. Thus, the microprocessor waits until the pressure transducer generates a signal corresponding to the existence of the optimum fluid pressure conditions external to the control housing and then generates a firing pulse which is conveyed to the detonator to effect the firing of the perforating gun.

The aforementioned microprocessor is provided with a memory circuit and, in effect, constitutes a miniature computer. The preselected level of underbalanced pressure at which firing of the perforating gun is desired is inputted into the memory of the microprocessor at the surface by a conventional personal computer.

A firing control method and apparatus embodying this invention thus assures that the perforating gun will not be fired during its insertion into the well because the microprocessor and the firing control circuit have not been armed by connection to the electrical power source contained within the control housing. Thus, if for any reason it is desired to remove the perforating gun from the well without firing same, such action may be safely accomplished. In fact, in view of the detachable connection provided between the firing control housing and the perforating gun, the firing control housing may be first removed from the well by wireline and then the unarmed perforating gun may be removed with absolute safety.

When the perforating gun is properly positioned in the well and the packer is set, the arming of the firing control mechanism is accomplished by increasing the tubing string pressure to a level above the well hydrostatic existing at the position of the perforating gun. Until the fluid pressure reaches this level, the rupture disc remains intact and the power source remains disconnected from the remainder of the firing control circuit. Once it is determined that the perforating gun is properly set and that other operations necessary for the firing of the perforating gun and handling and testing of the resulting production fluids have been effected, the fluid pressure in the tubing string is increased to effect the rupturing of the rupture disc and in turn effect the connection of the power source to the microprocessor and the electrical detonator, but the detonator will not be fired until the microprocessor generates a firing signal. The operator can then proceed to reduce the fluid pressure in the region surrounding the perforating gun by reverse circulation pumping, swabbing or other conventional techniques until the desired underbalanced pressure is achieved in the space surrounding the perforating gun. At this point, the microprocessor receives a signal from the pressure transducer which matches the preset level in the memory causing the microprocessor to actuate the electrical firing detonator, thus effecting the firing of the perforating gun under the optimum conditions.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
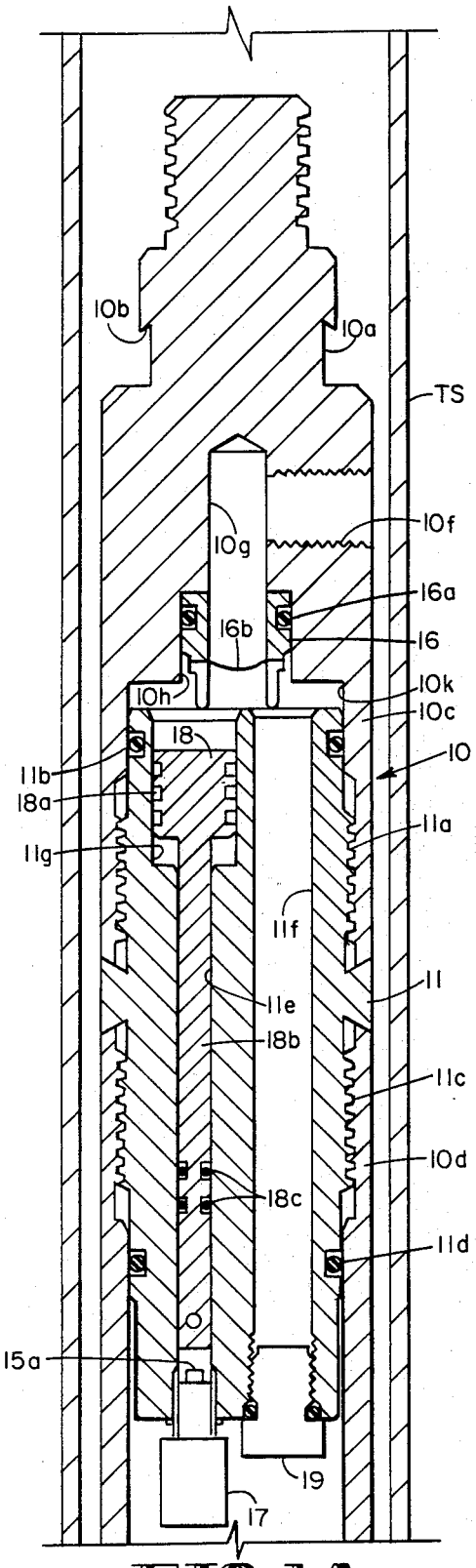
FIGS. 1A, 1B and 1C collectively represent a schematic vertical sectional view of a firing control mechanism for a well perforating gun.

Referring to the drawings, a firing control housing 10 is shown within a tubing string TS which supports a perforating gun 20 at its lower end at a desired position in the bore of a subterranean well.

Those skilled in the art will understand that a perforated nipple, or the like, and a packer are incorporated in the tubing string above the perforating gun but are not shown. The packer is set in the well bore, hence the fluid pressure in the tubing is the same as that surrounding the perforating gun.

Housing 10 is provided with a solid upper end portion 10*a* terminating in a fishing neck 10*b*. The lower portions of housing 10 are hollow and comprise an upper tubular portion 10*c* which is threadably and sealably connected to a nipple 11 which in turn connects to the upper end of an intermediate tubular housing extension 10*d* which terminates at its lower end in threads 10*e*. A detonator housing 12 is connected to threads 10*e* and sealed thereto by an O-ring 12*b* which is mounted in the threaded nipple shaped portion 12*c* of the detonator housing 12. A cylindrical housing extension 12*d* is connected to nipple threads 12*e* and sealed thereto by O-ring 12*f*.

The lower medial portion of the detonator housing 12 is provided with a solid thin walled web portion 12*g*. External threads 12*h* on the bottom end of detonator housing 12 provide a mounting for a conventional latching mechanism 14. Latching mechanism 14 comprises collet 14*a* having a ring portion 14*b* secured to threads 12*h*. Collet 14*a* has resilient arm portions 14*c* and enlarged head portions 14*d*. Latching segments 14*e* are secured to the interiors of arm portions 14*c* by shearable bolts 14*k*. Latching segments 14*e* are engagable with an appropriate downwardly facing shoulder 21*a* provided on the upper end of a primer extension housing 21 of the perforating gun 20. Thus, a detachable connection is provided for the firing control housing 10 to the upper end of the perforating gun 20, which can be released by an upward pull or jar on the fishing neck 10*b*.

Housing 21 has an extension 22 secured to its lower end by threads 21*a* and O-rings 21*b*. Extension 22 is sealably secured in a bore 20*a* of perforating gun 20 by threads 22*a* and O-rings 22*b*. As is customary, perforating gun 20 is sealably secured to the bottom end of tubing string TS by threads 20*a* and O-rings 20*b*.

A centralizer or spacer ring 25 is secured to extension 22.

Both primer housing 21 and extension 22 have small central bores 21*c* and 22*c* to receive a primer cord PC. The top end of bore 21*c* is counterbored to receive a booster charge BC. A metallic disc 23 overlies the counterbore and is adhesively secured to prevent the entrance of well fluids into the primer housing 21.

Above the transverse web 12*g*, a central bore 12' is provided within which an explosive charge 15 is mounted. The detonation of charge 15 will punch through the web 12*g* and disc 23 to detonate booster charge 48 and primer cord PC to fire the perforating gun 20.

While not shown in the drawings, those skilled in the art will recognize that the tubing string incorporates a packer above the perforating gun which is set in order to achieve underbalancing pressures. Additionally, the tubing string incorporates a perforated nipple or a side wall valve above the fire control mechanism to permit production fluids to flow to the surface after firing of the perforating gun.

Immediately below the fishing neck 10*b*, the upper portion of firing housing 10 is provided with a radial port 10*f* which in turn communicates with an axial bore 10*g* which has a downwardly facing enlarged counter bore 10*h*. A conventional annular rupture disc assemblage 16 is sealably mounted in counter-bore 10*h* by O-rings 16*a* and mounts a rupturable disc 16*b* in transverse relationship to the counterbore 10*h*. Thus, a predetermined fluid pressure has to be created within the bore of the tubing string TS within which the firing control housing 10 is mounted in order to effect the breaking of the rupture disc 16*b*.

The downwardly facing counterbore 10*h* communicates with a full diameter internal bore 10*k* defined by the firing control housing 10. The upper connecting nipple 11 is provided with external threads 11*a* and an externally mounted O-ring 11*b* for sealably connecting in the housing bore 10*k*. The lower end of the upper nipple connection 11 is provided with external threads 11*c* and an external O-ring 11*d* for sealably connecting to intermediate housing portion 10*d* of the fire control housing 10.

The upper connecting nipple 11 is not completely hollow but defines two axially extending bores 11*e* and 11*f*. The bore 11*e* is provided at its upper end with an upwardly facing counterbore 11*g*. A fluid pressure actuated piston 18 is mounted in counterbore 11*g* and is provided on its periphery with a labyrinth seal 18*a* which permits the piston 18 to be shifted by sudden surges of fluid pressure applied to its upper end but also provides a controlled leakage path around the piston 18 to maintain the piston in an intermediate position as shown in the drawings. Piston 18 is provided with a reduced diameter, downwardly extending stem portion 18*b* which sealably engages the bore 11*e* of the upper connecting nipple 11 by a pair of O-rings 18*c* mounted on piston stem portion 18*b*.

A microswitch housing 17 is threadably mounted in the lower end of the bore 11*e* and has an upwardly projecting operating plunger 15*a* which is engaged by the piston 18 to close the microswitch when the piston is moved downwardly by the sudden application of fluid pressure occasioned by the breakage of the rupture disc 16*b*.

The second bore 11*f* in the upper nipple 11 also receives a flow of pressured fluid when the rupture disc 16*b* is ruptured. A fluid pressure transducer unit 19 is threadably mounted in the lower end of bore 11*f* and functions in conventional manner to generate a signal, preferably digital, which varies in accordance with the magnitude of the applied fluid pressure.

Figure 2:
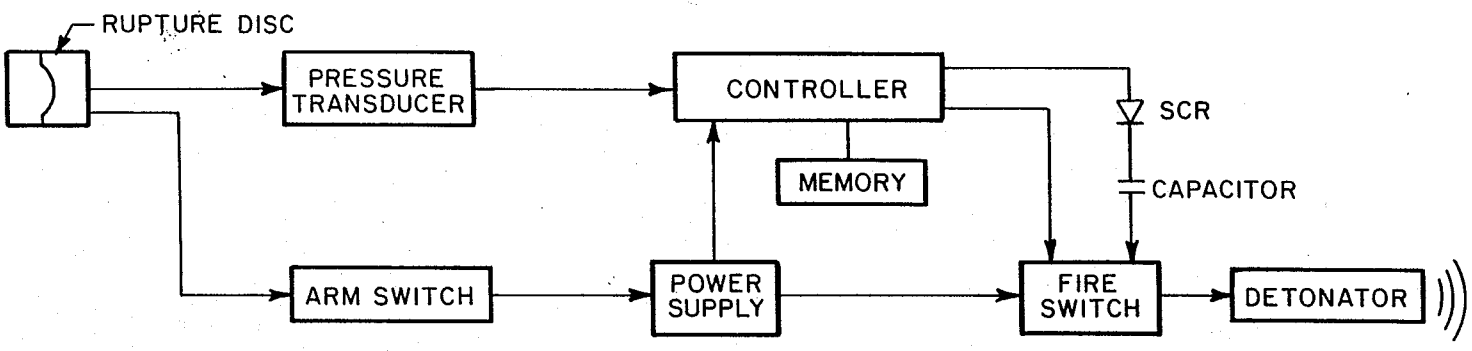
FIG. 2 is a schematic circuit diagram of the electrical fire control mechanism.

In the space provided within the bore of the intermediate portion 10*d* of the fire control housing 10, a cartridge 30 is mounted which contains a miniature computer comprising a microprocessor and a memory, a power supply unit, a capacitor on the order of 1–3 microfarads, and a firing switch. These elements are all conventional and hence are indicated merely by block diagrams. The circuit connections between these elements are shown in FIG. 2 of the drawings from which it will be observed that the power supply, which consists of appropriate batteries (not shown), is not connected to the microprocessor or the fire switch until the microswitch 15 has been actuated to a closed position by the downward movement of piston 18 following the severing of the rupture disc 16*b*. Similarly, the firing switch is not actuated until an appropriate signal has been received from the fluid pressure transducer 19. The memory is inputted at the surface by a conventional personal computer to respond to only a preselected tubing pressure level.

Upon energization of the microprocessor, a charge is built up across the capacitor on the order of 3–4 kilovolts and this charge is applied by the closing of the firing switch to an electrically energized detonator 40 through a conventional Kemlon connector 13 which prevents fluid from entering the firing housing 12 before or after discharge of perforating gun 20.

Figure 1B:
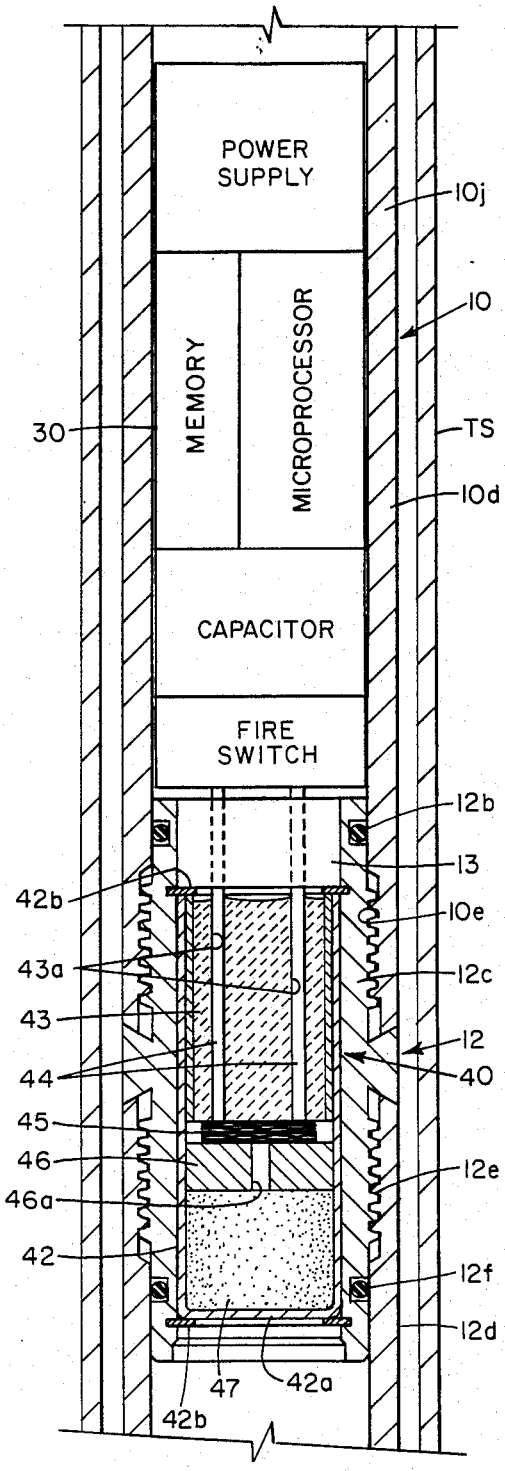
Figure 1C:
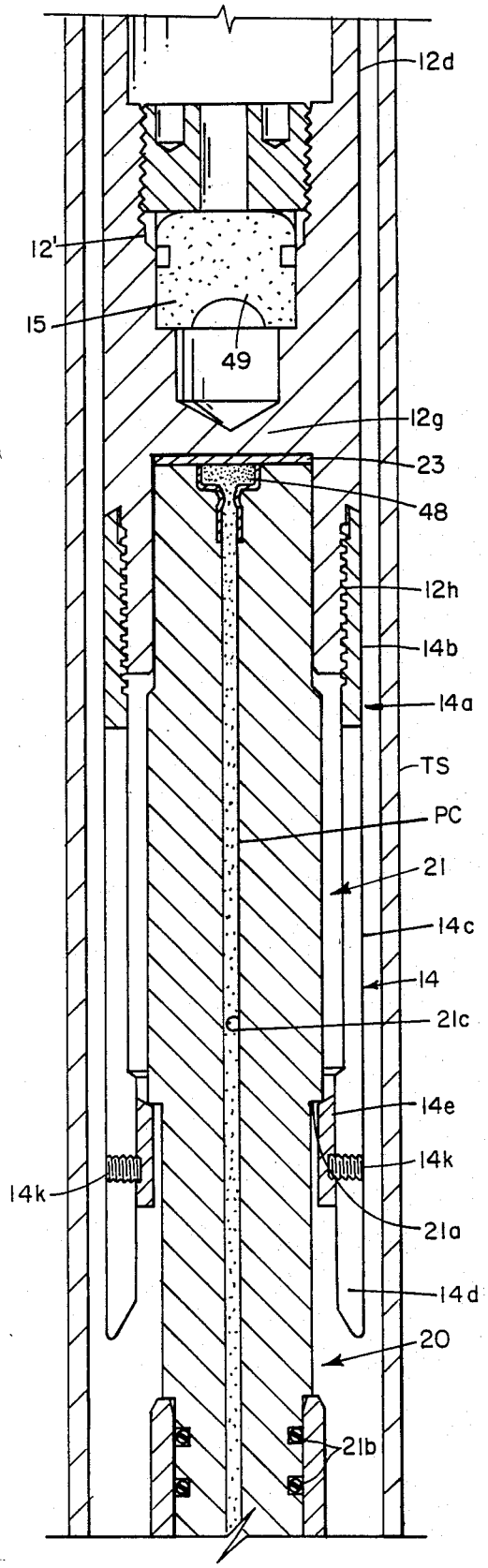
Figure 1D:
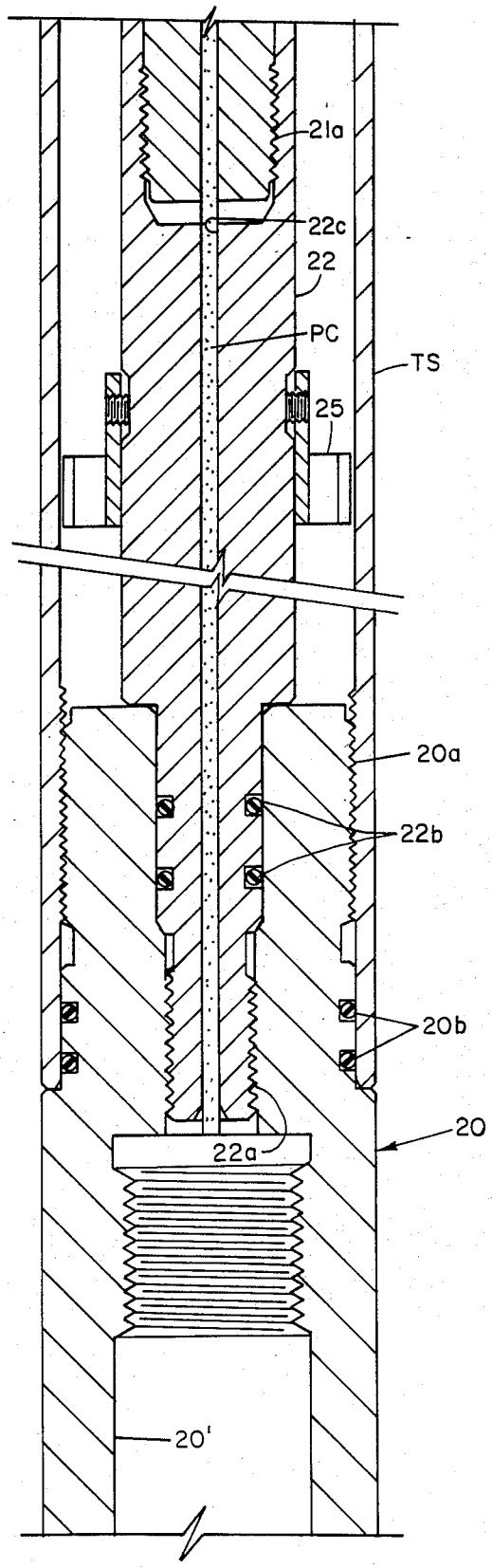

Detonator 40 is preferably of the type known as a foil driven slapper detonator which is shown in detail in FIG. 1B. Such detonator comprises a cup shaped metallic housing 42 having a relatively thin wall closed end 42*a*. Housing 42 is held in position within nipple 12 by any conventional means, such as C-rings 42*b*. The Kemlon connector 13 is threaded or attached into the open end of housing 42*a* and defines two axially extending bores 43*a* which sealably receive two wires 44 which are connected to opposite sides of the capacitor by the firing switch when the capacitor is charged to the desired level. The other ends of wires 44 are embedded in a foil disc 45 which is positioned adjacent a barrel disc 46 having a central bore or barrel 46*a*. The foil literally explodes when the capacitor discharges through it and the center portion of the foil is driven at high velocity through barrel 46*a* to impact and detonate an explosive charge 47. Such detonation blows out the thin bottom wall 42*a* of the housing 42 and detonates a downwardly directed shaped charge contained in a shaped charge container 49. Such detonation in turn blows a hole through the web 12*g* and detonates the booster charge 48 conventionally mounted in the top portion of perforating gun 20. Booster charge 48 effects the firing of perforating gun 20 in conventional fashion.

From the foregoing description, those skilled in the art will recognize the numerous advantages of the electrically actuated fire control mechanism for a perforating gun heretofore described. The safety features of the gun are outstanding. For optimum safety, the perforating gun may be installed downhole without the electrically actuated fire control mechanism and such mechanism may be lowered into position by wireline and detachably connected to the top end of the perforating gun by collet 14. Even in this operation, there is little danger of premature actuation of the fire control mechanism since such mechanism is not connected to its power source until the fluid pressure in the tubing string is raised to a predetermined level. After reaching such level, the rupture disc 16*b* is ruptured and fluid pressure is applied to the vertically shiftable piston 18, thus actuating the microswitch 17 which connects the power source to the electrical fire control mechanism. Even then, the mechanism will not fire until the fluid pressure transducer 19 detects a preselected pressure in the tubing string which represents the optimum conditions of underbalancing for the firing of the perforating gun. Either before or after the rupturing of the rupture disc 16*b*, the entire firing control mechanism may be removed from the well by a wireline tool engaging the fishing neck 10*b* provided at the top of the electrical firing control mechanism and imparting an upward jarring force to collet 14 which will shear bolts 14*k* and permit collet 14 to be released from extension 21 of the perforating gun 20. With the electrical firing control mechanism removed, there is no danger of the perforating gun 20 being prematurely discharged, since such gun contains only secondary explosives which require the application of a very substantial detonating force to effect their firing.

In the normal sequence of events, the rupture disc 16*b* is ruptured by increasing the tubing string pressure and the well operator then knows that all he has to do to effect the firing of the perforating gun is to raise or lower the tubing string fluid pressure to the preselected level which will cause a generation of an appropriate signal in the pressure transducer 19 which, when compared with the preset pressure level stored in the downhole memory, will result in the actuation of the fire control switch and the subsequent detonation of the perforating gun. The operator does not need to be concerned about the time required to achieve the desired optimum underbalancing fluid pressure because the firing of the perforating gun is completely independent of time.

In addition it will be noted that all electrical elements contained within the cartridge 30 are protected from well fluids, hence may be repeatedly used.

Although the invention has been described in terms of a specific embodiment which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a mechanism for electrically firing a tubing supported perforating gun in a subterranean well comprising:

a housing insertable in the tubing and releasably securable to the perforating gun, said housing containing a power supply, electrical means for generating an electrical gun firing pulse and a mechanical switch for connecting said power supply to said electrical means;

a hydrostatic pressure responsive rupture disc forming a wall of said housing;

a cylinder mounted within said housing, whereby the rupture of said rupture disc by increasing the fluid pressure in the tubing permits said fluid pressure to be applied to said cylinder; and a piston slidably and sealably mounted in said cylinder and operatively connected to said mechanical switch to close same in response to the rupture of said rupture disc.

2. The apparatus of claim 1 further comprising labyrinth seal means between said cylinder and said piston, whereby fluid leakage around said rupture disc will not shift said piston.

3. The apparatus of claim 1 further comprising:

a pressure transducer mounted in said housing and positioned to be contacted by said tubing pressure after rupture of said rupture disc;

said pressure transducer supplying an electrical signal to said electrical means representing said tubing fluid pressure;

said electrical means being preset to generate an electrical gun firing pulse only upon the occurrence of a preselected value of said tubing pressure after the rupture of said rupture disc.

4. The apparatus of claim 3 wherein said electrical means comprises a microprocessor and memory addressable at the well surface by a computer to input said preselected value of annulus pressure into said memory.

5. The method of firing a perforating gun in a subterranean well under optimum fluid pressure conditions surrounding the perforating gun comprising the steps of:

suspending the perforating gun adjacent a production formation by a tubing string extending to the well surface, said tubing string incorporating a packer engagable with the well bore above said perforating gun;

disposing a hollow housing adjacent to said perforating gun and having its interior isolated from well fluids by a fluid pressure operated valve responsive to a first level of pressure of fluid surrounding said perforating gun, said housing containing an electrical power source, a fluid pressure transducer, a microprocessor and an electrical firing pulse generator;

connecting said power source to said microprocessor in response to the opening of said valve; and, energizing said electrical firing pulse generator by said microprocessor in response to a signal from said fluid pressure transducer indicating the existence of a second preselected fluid pressure level surrounding said perforating gun.

6. The method of claim 5 wherein said microprocessor includes a memory unit, and further comprising inputting said memory unit at the surface to detect said second preselected level of fluid pressure at which firing of said perforating gun is desired.

7. The method of claim 5 further comprising the step of detachably securing said hollow housing to said perforating gun, thereby permitting said hollow housing to be retrieved from the perforating gun.

* * * * *